US006562086B1

(12) United States Patent
Gentry et al.

(10) Patent No.: US 6,562,086 B1
(45) Date of Patent: May 13, 2003

(54) FATTY ACID AMIDE LUBRICITY AIDS AND RELATED METHODS FOR IMPROVEMENT OF LUBRICITY OF FUELS

(75) Inventors: David R. Gentry, St. Louis, MO (US); Mark P. Stehlin, Fenton, MO (US); Jerry J. Weers, Ballwin, MO (US)

(73) Assignee: Baker Hughes Inc., Houston, TX (US)

( * ) Notice: Subject to any disclaimer, the term of this patent is extended or adjusted under 35 U.S.C. 154(b) by 815 days.

(21) Appl. No.: 08/883,634

(22) Filed: Jun. 26, 1997

(51) Int. Cl.[7] ..... C10L 1/22
(52) U.S. Cl. ..... 44/418; 44/419
(58) Field of Search ..... 44/418, 419

(56) References Cited

U.S. PATENT DOCUMENTS

| | | | | | |
|---|---|---|---|---|---|
| 1,692,784 | A | * | 11/1928 | Orelup et al. | 44/418 |
| 2,456,569 | A | * | 12/1948 | Smith | 44/418 |
| 2,843,464 | A | * | 7/1958 | Gaston et al. | 44/418 |
| 3,017,362 | A | | 1/1962 | Cyba | 252/51.5 |
| 3,615,291 | A | | 10/1971 | Thayer | 44/58 |
| 3,644,393 | A | | 2/1972 | Thayer | 260/309.6 |
| 4,204,481 | A | | 5/1980 | Malec | 123/1 A |
| 4,209,411 | A | | 6/1980 | Winans et al. | 252/56 D |
| 4,230,588 | A | | 10/1980 | Bonazza et al. | 252/51.5 A |
| 4,243,538 | A | * | 1/1981 | Shubkin | 44/418 |
| 4,836,829 | A | * | 6/1989 | Zimmerman et al. | 44/418 |
| 5,336,277 | A | | 8/1994 | Poirier et al. | 44/343 |
| 5,352,377 | A | | 10/1994 | Blain et al. | 252/51.5 R |
| 5,420,185 | A | | 5/1995 | Watanabe et al. | 524/210 |
| 5,440,059 | A | | 8/1995 | Alink | 554/220 |
| 5,569,407 | A | | 10/1996 | Avery et al. | 508/454 |

FOREIGN PATENT DOCUMENTS

| | | | |
|---|---|---|---|
| WO | WO 94/17160 | 8/1994 | C10L/1/18 |
| WO | WO 96/21709 | 7/1996 | C10L/1/22 |

OTHER PUBLICATIONS

ASTM D 975–96a, Standard Specification for Diesel Fuel Oils. Date unknown.

"The Lubricity of Diesel Fuels", Wei, et. al., *Wear*, 111 (1986) 217–235. Date unknown.

"Lubricity Additives—Performance and No–Harm Effects in Low Sulfur Fuels", Batt, et al., SAE 961943 (1996). Month unknown.

"Development of Laboratory Tests to Predict the Lubricity Properties of Diesel Fuels and their Application to the Development of Highly Refined Diesel Fuels", Bovington, et. al., *Tribotest Journal* 2–2, Dec. 1995, (2) 93 1354–4063.

"Severe Hydrotreating of Diesel Can Cause Fuel–Injector Pump Failure", Booth, et. al., *Oil and Gas Journal*, Aug. 16, 1993, 71–76.

ASTM D 1094–85, Standard Test Method for Water Reaction of Aviation Fuels. Date unknown.

"Preparation, Analysis and Use of Alkanolamides", *Alkanolamines Handbook*, Dow Chemical Company, 37–44 (1964). Month unknown.

"Diesel Fuel Lubricity by Standard Four Ball Apparatus Utilizing Ball on Three Disks, BOTD", Voitik, et. al., SAE 950247 (Feb.–Mar. 1995).

"Diesel Fuel Lubricity: BOTD Status—1995", Voitik, SAE 952371 (Oct. 1995).

Falex Ball–on–Three–Disks, Typical Test Procedure. Date Unknown.

* cited by examiner

*Primary Examiner*—Margaret Medley
(74) *Attorney, Agent, or Firm*—Thompson Coburn LLP

(57) ABSTRACT

A fuel composition of improved lubricity comprises a lubricity-increasing amount of a lubricity aid dissolved in low sulfur diesel fuel and spark ignition fuels. The lubricity aid is an alkanolamide of a fatty acid, an alkanolamide of a modified fatty acid or a mixture thereof. If the lubricity aid is other than an alkanolamide of an aryl-substituted fatty acid, the composition further necessarily comprises a haze-inhibiting amount of a dehazer. The lubricity of such fuels may be enhanced without acceptably increasing the tendency of the fuel to become hazy upon contact with water.

22 Claims, No Drawings

FATTY ACID AMIDE LUBRICITY AIDS AND RELATED METHODS FOR IMPROVEMENT OF LUBRICITY OF FUELS

BACKGROUND OF THE INVENTION

1. Field of the Invention

The present invention relates to improvement of lubricity of fuels, and more particularly to chemical treatment of low sulfur diesel fuels and spark ignition fuels for improvement of lubricity.

2. Description of the Prior Art

Low sulfur diesel fuels were developed in the early 1990s in response to environmental concerns. Such fuels are prepared by severely hydrotreating diesel components to produce a low sulfur, olefin and aromatic content fuel. Standards have been set for such low sulfur content fuels. According to ASTM Standard Specification for Diesel Fuel Oils D-975-96a low sulfur diesel fuel has a maximum sulfur content of 0.05% based on mass, versus levels as high as 0.5% or more for equivalent standard diesel fuels. As used herein, the phrase "low sulfur diesel fuels" refers to such hydrotreated fuels of maximum sulfur content of 0.05% based on mass.

While such fuels are desirable from an environmental standpoint, they suffer from a serious problem of substantially reduced lubricity. "Lubricity" refers to the lower friction, wear or scuffing that a liquid may give compared to another liquid of the same viscosity. See, for example, "The Lubricity of Diesel Fuels," Wei, D. et al., Wear, 111 (1986), pp. 217–235.

Many articles have discussed low sulfur diesel fuels and their poor lubricity characteristics. For example, see "Lubricity Additives—Performance and No-Harm Effects in Low Sulfur Fuels," Batt, R. J., et al., SAE Publication 961943 (1996); "Development of Laboratory Tests to Predict the Lubricity Properties of Diesel Fuels and the Application to the Development of Highly Refined Diesel Fuels," Bovington, C. et al., Tribotest Journal 2—2, December 1995, (2) 93 1354–4063; and PCT patent application, International Publication No. WO 94/17160 (Exxon Chemical Patents, Inc.); all of which are incorporated herein by reference. The cited PCT patent publication (p. 1), notes that the poor lubricity of the low sulfur diesel fuel creates a serious problem because "the ability of the fuel to lubricate the injection system of the engine is reduced such that, for example, the fuel injection pump of the engine can fail relatively early in the life of an engine . . ."

This concept of lubricity and lubricity additives, to which the present invention is directed, is distinct from wear-reducing additives as used in lubricants and in lubricity additives. Moreover, although mainly boundary lubrication, where the additive forms a layer between the two metal surfaces, is thought to be operative, mechanisms of providing good lubricity varying from boundary lubrication to hydrodynamic (hydraulic lubrication) have been suggested as the role of lubricity additives.

Thus, U.S. Pat. No. 4,204,481 (Malec) appears to be directed to wear in injectors in conjunction with standard relatively high sulfur content fuel. For instance, in the "Background of the Invention," Malec reports that certain alcohols have been substituted for conventional petroleum-derived diesel fuels and that while such alcohols (with the addition of certain accelerators) may be used as fuels, they are "notably deficient in lubricity or lubricating properties with the result that engine wear from the use of these fuels in internal combustion reciprocating diesel engines is a serious problem . . ." and of "particular concern are wear problems associated with the fuel injector mechanisms used in such engines." By contrast, the subject invention is directed to lubricity at fuel pumps, in particular, rotary/distributer pumps, where the lubricant is the fuel itself, and which as a result are the cite of most wear problems as opposed to in-line fuel pumps which are lubricated by engine oil. See, for instance, "Severe Hydrotreating of Diesel Can Cause Fuel-Injector Pump Failure," Booth, M. et al., Oil and Gas Journal, Aug. 16, 1993, pp. 71–76.

As reported in the cited Tribotest Journal article and elsewhere, temperature and wear mechanisms present are critical in determining whether a pump will fail. These considerations of temperature and wear mechanisms emphasize the distinctive nature of the lubricity problem as opposed to the problem of injector wear, to which the cited Malec patent is directed. Injectors, are subjected not only to very high cylinder temperatures (and so operate at much higher temperatures than do fuel pumps), but also to a substantially different wear mechanism than are fuel pumps. In particular, injectors experience linear (up and down) type of wear, while fuel pump wear is the result of sliding and rotary components from the action of the pump. And it has been noted that adhesion, sliding wear, oxidative and fatigue wear are all found in fuel pumps using poor lubricity fuel.

Some lubricity aids have been developed for low sulfur diesel fuels, but each suffers from one or more drawbacks when applied to such fuels. For example, many additives are fatty acids or modified fatty acids and so are acidic in character, which is undesirable due to concerns that they will react or otherwise interfere with the effectiveness of other additives, such as amine surfactants. Other additives are esters, but have several free hydroxide groups on the molecules which cause the additive to exhibit poor water tolerance and high dose rates may be required. Likewise, imidazolines have been found to have poor water tolerance and/or poor hydrolytic stability, resulting in precipitate formation upon extended exposure to moisture. Still other additives increase the tendency of the fuel to form an emulsion and thus to become hazy upon exposure of the fuel to moisture. Generally, however, low sulfur diesel fuels are so new that few lubricity aids have been developed for them, regardless of efficacy or drawbacks.

Moreover, although low sulfur diesel fuel is of particular concern, there is a continual search for new alternative lubricants for spark ignition fuels as well.

SUMMARY OF THE INVENTION

The present invention, therefore, is directed to a novel fuel composition of improved lubricity. The fuel composition comprises a lubricity-increasing amount of a lubricity aid dissolved in a fuel selected from the group consisting of low sulfur diesel fuel and spark ignition fuels. The lubricity aid is an alkanolamide of a fatty acid, an alkanolamide of a modified fatty acids or a mixture thereof, provided that if the lubricity aid is other than an alkanolamide of an aryl-substituted fatty acid, the composition further necessarily comprises a haze-reducing amount of a dehazer.

The present invention is also directed to a fuel lubricity additive comprising about 3 to about 20 parts by weight lubricity aid per part by weight dehazer, the lubricity aid being selected from the group consisting of alkanolamides of fatty acids, alkanolamides of modified fatty acids and mixtures thereof.

The present invention is further directed to a method for improving the lubricity of a low sulfur diesel or spark ignition fuel. According to the method, a lubricity-increasing amount of a lubricity aid is added to the fuel. The lubricity aid is selected from the group consisting of alkanolamides of fatty acids, alkanolamides of modified fatty acids and mixtures thereof. If the lubricity aid is an alkanolamide of an aryl-substituted fatty acid, it is preferred that a haze reducing amount of a dehazer is also added to the fuel. If the lubricity aid is other than an alkanolamide of an aryl-substituted fatty acid, a haze-reducing amount of a dehazer must also be added to the fuel.

Among the several advantages of this invention, may be noted the provision of a superior lubricity aid for use in low sulfur diesel fuel and spark ignition fuels; the provision of such aid that does not cause or increase hazing of the fuel when the fuel contacts water; the provision of such aid that is effective when used in relatively low dosage; the provision of such aid that has a low acid number; and the provision of a method for increasing the lubricity of such fuels with such aid.

DETAILED DESCRIPTION OF THE PREFERRED EMBODIMENTS

In accordance with the present invention, it has been discovered that certain alkanolamides of aryl-substituted fatty acids have low acid numbers, yet impart exceptional lubricity to low sulfur diesel fuels and spark ignition fuels and, moreover, if the alkanolamide of an aryl-substituted fatty acid—or even if another low acid number alkanolamide of a fatty acid or modified fatty acid—is used in combination with a dehazer, the tendency of the fuel to haze is notably lessened. Moreover, it has been found that desirable levels of lubricity can be attained with surprisingly low dosages of the lubricity aid.

Thus, the lubricity aid of this invention comprises an alkanolamide of a fatty acid or a modified fatty acid. The alkanolamide may be prepared by reacting an alkanolamine with an acid or modified fatty acid by well known techniques. The term "alkanolamine" (and so, correspondingly, "alkanolamide") is used in its broadest sense to include, for example, monoalkanolamines, dialkanolamines, and so forth. It is believed that almost any alkanolamine can be used, although preferred alkanolamines are lower alkanolamines, generally having from about two to about six carbon atoms. It has been found that it is highly desirable that a hydroxy group or an NH group be located at a position two carbon atoms from the nitrogen that forms the amide. Thus, while use of morpholine resulted in a poor lubricity aid, use of diethanolamine produced excellent lubricity aids. It is also preferred that the alkanolamide have an O or N functionality in addition to the one amino group (that group being a primary or secondary amino group) and the hydroxy group required by the generic name "alkanolamine;" for example, dialkanolamines and amino-alkanolamines. Thus, suitable alkanolamines include monoethanolamine, diethanolamine, dipropanolamine and, to a lesser extent, aminoethylaminoethanol such as 2-(2-aminoethylamino) ethanol.

It is believed that the fatty acid may be any fatty acid. Thus, for example, any of the common species, such as coco, lauric, stearic, oleic, linoleic, linolenic, ricinoleic, tall oil, tallow acid are suitable. Likewise, modified fatty acids may be used as well. Modified fatty acids are isomeric forms of the natural and common species, such as isostearic acid, and substituted fatty acids in which, for example, an alkyl group (of up to, for example, twelve carbon atoms) or aryl group (of, for example, about six to about eighteen carbon atoms) is substituted for a hydrogen (or at a broken double bond) of the unsubstituted fatty acid. Examples of this latter case with aryl substituents include phenylstearic acid, tolylstearic acid and xylylstearic acid. Although the modified and unmodified fatty acids generally have from about 12 to about 24 carbon atoms, efficacy does not seem to vary within this range.

The alkanolamide may be modified by esterifying the hydroxyl groups remaining after amide formation, for example, with salicylic acid or glycolic acid. However, no improvements have been noted in connection with such esterification, and some esterification reactants, such as acetoacetic acid, have been noted to harm lubricity efficacy.

As noted above, the amide may be formed by well known techniques. For example, in one method, the amine (or amines) and fatty acid (or fatty acids) are mixed together in an amine to carboxylic groups of the acid molar ratio of from about 1.2:1 to about 1:3 and heated to 140° C. or higher to drive off water formed in the resulting condensation reaction. In an alternative method, the methyl ester of the acid is formed and then reacted with the amine at a temperature of from about 60° C. to about 100° C., eliminating methanol. Although the first method is simpler, its yield is lower, generally about 70%, and side reactions of the alkanolamine with itself form undesirable side products which can have a negative impact on the total solubility of the additive in fuel. By contrast, the second method is a more involved manufacturing process and produces extraneous sodium product, but also produces a product of excellent clarity and greater than 90% yield, with no insoluble by-products.

While these techniques for producing the alkanolamide are well known, it is believed that the commercial alkanolamides used as lubricity aids are made by yet a third technique; namely, by reacting the alkanolamide with one or more fatty triglyceride instead of one or more fatty acid, and then separating the glycerin by-product. Here, it has been found that the techniques based on fatty acids rather than fatty triglycerides yield excellent results.

By contrast to the acidic prior art lubricity aids, which can have acid numbers in excess of 120 mgKOH/g of sample, the amides of this invention have been found to have acid numbers of less than about 25 mgKOH/g of sample. Thus, as used herein, "low acid number lubricity aids" refers to active compositions with acid numbers of less than about 25 mgKOH/g of sample. More preferably, the acid number of the lubricity aid is less than about 10 mgKOH/g of sample, and even more preferably less than about 5 mgKOH/g of sample. The most preferred amides have acid numbers of less than about 1 mgKOH/g of sample.

Surprisingly, it has been found that the amide formed from aryl-substituted fatty acid provides excellent lubricity enhancement to the fuels of interest herein. And while certain species and certain fuels may allow their use without a dehazer or further treatment to maintain the water tolerance of the fuel (that is, in some situations the aryl-substituted amide does not unacceptably increasing the tendency of the fuel to form a haze upon contact with water), the use of a dehazer provides superior water tolerance even with the aryl-substituted amides. Thus, it has now been found that the increased tendency to haze associated with lubricity aids is suppressed by inclusion of a dehazer. While the term "dehazer" might suggest in certain contexts that the medium to be treated is hazy prior to treatment and that the haziness is reduced or eliminated therefrom, as used herein, it should be understood to refer to prevention or inhibition of haziness as well. Thus, when added to a clear fuel—a fuel that is not hazy—, but that has a tendency to form a haze upon exposure to water, the dehazer will inhibit haze formation upon exposure of the fuel to water. Thus, the dehazer may be described as an emulsion preventative or emulsion inhibitor.

Dehazers are well known in the art as demulsifiers suitable for use in fuels. It is believed that any dehazer for fuel will have some degree of efficacy in the present application. However, particularly effective dehazers have been found to be glycol oxyalkylate polyol blends (such as sold by Petrolite Corporation under the trade designation TOLAD® 9312), phenol/formaldehyde or alkyl($C_{1-18}$)phenol/-formaldehyde resin oxyalkylates modified by oxyalkylation with $C_{1-18}$ epoxides and diepoxides (such as sold by Petrolite Corporation under the trade designation TOLAD® 9308), and $C_{1-4}$ epoxide copolymers cross-linked with diepoxides, diacids, diesters, diols, diacrylates, dimethacrylates or diisocyanates, all of which types are well known in the art, and blends thereof. The glycol oxyalkylate polyol blends may be polyols oxyalkylated with $C_{1-4}$ epoxides. The alkyl($C_{1-18}$)phenol/-formaldehyde resin oxyalkylates modified by oxyalkylation with $C_{1-18}$ epoxides and diepoxides may be based on, for example, cresol, t-butyl phenol, dodecyl phenol or dinonyl phenol, or a mixture of phenol (such as a mixture of t-butyl phenol and nonyl phenol). By contrast, demulsifiers such as amine oxyalkylates and sulfonates are not useful in fuels and so are not considered dehazers and are not applicable here.

If a dehazer is used, it may be mixed with the lubricity aid to produce a lubricity additive. Generally the additive should comprise about 3 to about 20 parts by weight lubricity aid per part by weight dehazer. The optimal amount and type of dehazer depend on the water emulsifying properties of the fuel to which the lubricity aid is added, as will be readily understood to those of ordinary skill in the art of fuel treatment, particularly demulsification.

The lubricity additive is incorporated by standard techniques into the fuel to be treated. Any poor lubricity fuel (that is, any fuel having undesirably low lubricity) may be treated, including spark ignition fuels such as gasoline and kerosene, although the present lubricity aids are particularly well suited to low sulfur diesel fuel. The amount to be incorporated is simply an amount such that the lubricity aid is present in the fuel in an amount sufficient to increase the lubricity of the fuel. This amount will be referred to herein as "the lubricity-increasing amount" and has been found to be generally from about 10 to about 500 ppm lubricity aid based on weight of the fuel. Preferably, the lubricity aid is used in a concentration of from about 20 to about 100 ppm, more preferably about 10 to about 50 ppm, based on the weight of the fuel.

The dehazer, likewise, should be used in an amount sufficient to inhibit the hazing that might otherwise occur when the fuel without the dehazer contacts water, and this amount will be referred to herein as a "haze-inhibiting amount." Generally, this amount is from about 1 to about 50 ppm based on the weight of the fuel. The relative proportion of lubricity aid toldehazer in the lubricity additive discussed above is coordinated so that appropriate concentrations of both components can be produced in the fuel.

The lubricity aid of this invention has been found to be extremely well-suited to low sulfur diesel fuel, with a very low dosage providing excellent lubricity without producing a hazing problem and without the side-reaction problems associated with acidic lubricity aids. Moreover, it has been found that the lubricity aid of this invention is similarly well-suited for use in spark ignition fuels such as gasoline and kerosine.

The following examples describe preferred embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the example. In the examples, all percentages are given on a weight basis unless otherwise indicated.

EXAMPLE 1

Xylylstearic acid having an acid number of about 145 mgKOH/g and an effective equivalent weight of about 388 g/equiv. was prepared according to U.S. Pat. No. 5,440,059 (Alink). The xylylstearic acid (29.97 g; 0.077 eq.) was added to a 100 ml flask with diethanolamine (8.11 g; 0.077 eq.) and xylene (16 g). The resulting mixture was heated at up to 158° C. until all the water formed in the reaction was removed by means of an azeotrope with xylene—about five hours. Whatever xylene was remaining in the Dean Stark trap was returned to the flask, resulting in a mixture comprising 70% reaction product and 30% xylene. The acid number of the product was 0.61 mgKOH/gram of sample. The product was tested for lubricity in Shell P-50 diesel, and 200 ppm gave a wear scar (WSD) of 0.2575 mm using the Falex Ball-on-Three Disk (BOTD) Friction test rig, versus wear scars of generally about 0.5 mm to about 0.65 mm for untreated fuel and about 0.3 mm to about 0.35 mm for 200 ppm of a commercial amide as described in U.S. Pat. No. 4,204,481 (Malec).

Scale-up (11.5 times above reactant amounts) produced a product with an acid number of 0.34 mgKOH/g of sample. The scale-up product was tested for lubricity in Low Sulfur Fuel B, and 100 ppm gave a wear scar (WSD) of 0.433 mm using the Falex Ball-on-Three Disk (BOTD) Friction test rig, versus wear scar of about 0.51 mm for untreated fuel.

EXAMPLE 2

Xylylstearic acid (119.6 g., 0.307 mole) was dissolved in methanol (238.6 g., 7.5 moles) in a one liter flask. While stirring at ambient laboratory temperature, concentrated sulfuric acid (1.0 ml.) was added. Stirring was then continued for 90 minutes at a temperature range from about 20° C. to about 65° C., during which the mixture became cloudy as methyl xylylstearate formed and separated from the excess methanol. The mixture was then transferred to a separatory funnel and the phases were allowed to separate. The lower layer, consisting essentially of methyl xylylstearate, was recovered in about 88% yield. Methyl xylylstearate (30.3 g., 0.075 mole) and diethanolamine (8.66 g., 0.0825 mole) (1.0:1.1 mole ratio of methyl xylylstearate to diethanolamine) were mixed in a 100 ml. flask equipped with a thermometer, condenser and stirrer, then sodium methoxide (0.29 g., 0.75% by wt.) was added and the reaction mixture was heated to 100–110° C. for about 4 hours. Vacuum and nitrogen sparge were used to aid in the removal of evolved methanol to yield 35.5 g. of clear viscous product. The product was tested for lubricity performance in kerosene at 100 ppm using the Falex Ball-on-Three Disk (BOTD) friction test rig, giving a wear scar (WSD) of 0.3017 mm compared to a WSD of 0.3592 mm for a sample prepared according the procedure of Example 1 tested under the same conditions.

EXAMPLES 3–16

Further examples prepared according to the procedure of Example 1 are described in Table 1. In Table 1, SYLVADYM® MX Dimer Acid is a mixture of dimer acids available from Arizona Chemical Co. and the notation "Mixed Acid" refers to a composition of 44–48% mixed fatty acids, 52–56% dimer acids with acid number of 160–175 mgKOH/gram.

The acid number of the product of Example 10 was 2.6 mgKOH/g of sample.

TABLE 1

| Example | Carboxylic Acid Used | Amine Used | Mole Ratio of Carboxylic Groups to Amine |
|---|---|---|---|
| 3 | Ricinoleic | Diethanol amine | 1:1.2 |
| 4 | Ricinoleic | Monoethanol amine | 1:1.2 |
| 5 | Ricinoleic | Aminoethyl-aminoethanol | 1:1.2 |
| 6 | SYLVADYM ® MX Dimer Acid | Diethanol amine | 1:1.2 |
| 7 | Mixed Acid | Diethanol amine | 1:1 |
| 8 | Mixed Acid | Mono-isopropanol amine | 1:1 |
| 9 | Naphthenic | Diethanol amine | 1:1 |
| 10 | Xylylstearic | Diethanol amine | 1:1.1 |
| 11 | Xylylstearic | Aminoethyl-aminoethanol | 1:1.1 |
| 12 | Xylylstearic | Morpholine | 1:1.1 |
| 13 | Xylylstearic | Di-isopropanol amine | 1:1.1 |
| 14 | Xylylstearic | Methylamino ethanol | 1:1.2 |
| 15 | Xylylstearic | Diethanol amine | 1.1:1 |
| 16 | Xylylstearic | Diethanol amine | 3:1 |

EXAMPLE 17

WITCAMIDE® 511 alkanolamide (24.5 g., 0.1 eq.) (commercial diethanol amide of crude oleic acid from Witco) was heated to 140°C. in a flask equipped with a thermometer, stirrer, and condenser. Then tert-butyl acetoacetate (15.8 g., 0.1 mole) was added rapidly and the mixture was heated to 140° C. for 1 hour with removal of tert-butyl alcohol.

EXAMPLE 18

WITCAMIDE® 511 alkanolamide (24.5 g., 0.1 eq.) was reacted with tert-butyl acetoacetate (7.9 g., 0.05 mole) according to the procedure of Example 17.

EXAMPLE 19

WITCAMIDE® 511 alkanolamide (24.5 g., 0.1 eq.) was reacted with salicylic acid (6.9 g., 0.05 mole) according to the procedure of Example 1.

EXAMPLE 20

WITCAMIDE® 511 alkanolamide (24.5 g., 0.1 eq.) was reacted with glycolic acid (5.43 g. 70% aq.) according to the procedure of Example 1.

EXAMPLE 21

Standard lubricity improvement tests were carried out on the compositions of Examples 3–20, above, in four types of diesel fuel and kerosene. The data presented in Table 2 were generated using the Falex Ball-on-Three Disk (BOTD) friction test rig, wherein P50 Diesel is P50 low sulfur winter diesel fuel from northern Canada, LSF A and LSF B are Low Sulfur Fuel A and Low Sulfur Fuel B, respectively, and the final five rows show comparisons to the results with WITCAMIDE® 511 alkanolamide unreacted with any acid and with TOLAD® 9103 Fuel Lubricity Additive of Petrolite Corporation, a commercial acidic lubricity aid. The data presented in Table 3 were generated using the High Frequency Reciprocating Rig (HFRR) friction test rig, wherein SW-1 is Swedish Class 1 low sulfur diesel fuel, LSF A and LSF B are Low Sulfur Fuel A and Low Sulfur Fuel B, respectively, and the final four rows show comparisons to the results with TOLAD® 9103 Fuel Lubricity Additive. The doses identified in Table 2 for Examples 3–20 are presented in ppm by weight active ingredients. The doses identified in Table 2 for WITCAMIDE® 511 alkanolamide and TOLAD® 9103 Fuel Lubricity Additive, and all doses identified in Table 3 are ppm by weight additive.

TABLE 2

| | | BOTD Wear Scar, mm | | | |
|---|---|---|---|---|---|
| Example | Dose ppm | P50 Winter Diesel | LSF A | LSF B | Kerosene |
| Blank | — | 0.54–0.64 | 0.447 | 0.51 | 0.45–0.52 |
| 3 | 100 | 0.298 | | | |
| 4 | 100 | 0.323 | | | |
| 5 | 100 | 0.274 | | | |
| 6 | 75 | 0.380 | | | |
| 6 | 100 | 0.349 | | | |
| 7 | 100 | 0.293 | | | |
| 8 | 100 | 0.326 | | | |
| 9 | 100 | 0.433 | | | |
| 10 | 50 | | 0.403 | 0.443 | |
| 10 | 100 | 0.284 | 0.309 | 0.398 | |
| | | | | 0.401 | |
| 10 | 150 | | 0.393 | 0.360 | |
| 10 | 200 | | 0.333 | | |
| 11 | 100 | 0.321 | | | |
| 12 | 100 | 0.495 | | | |
| 13 | 200 | | 0.371 | | |
| 14 | 100 | 0.456 | | | |
| 15 | 100 | | | | 0.429 |
| 16 | 100 | 0.357 | | | |
| 17 | 100 | | | 0.468 | |
| 18 | 100 | | | 0.439 | |
| 19 | 100 | | | 0.471 | 0.323 |
| | | | | | 0.370 |
| 19 | 200 | | | | 0.317 |
| 20 | 100 | | | 0.438 | 0.311 |
| WITCAMIDE ® 511 Alkanolamide | 50 | 0.337 | | | |
| WITCAMIDE ® 511 Alkanolamide | 100 | 0.315 | | | |
| WITCAMIDE ® 511 Alkanolamide | 200 | 0.179<br>0.192<br>0.333 | | | |
| TOLAD ® 9103 Fuel Lubricity Additive | 50 | 0.326 | 0.391 | 0.420 | |
| TOLAD ® 9103 Fuel Lubricity Additive | 100 | 0.308<br>0.342 | 0.325 | 0.410 | |

TABLE 3

| | | HFRR Wear Scar, microns | | |
|---|---|---|---|---|
| Example | Dose, ppm | SW-1 | LSF A | LSF B |
| Blank | — | 650 | 606 | 623 |
| Example 10 | 50 | 612 | 537 | 514 |

TABLE 3-continued

| Example | Dose, ppm | HFRR Wear Scar, microns SW-1 | LSF A | LSF B |
|---|---|---|---|---|
| Example 10 | 100 | 582 | 232 | 410 |
| Example 10 | 150 | 366 | 388 | 421 |
| Example 10 | 200 | 223 | — | — |
| TOLAD ® 9103 Fuel Lubricity Additive | 50 | 640 | 513 | 452 |
| TOLAD ® 9103 Fuel Lubricity Additive | 100 | 594 | 426 | 382 |
| TOLAD ® 9103 Fuel Lubricity Additive | 150 | — | 384 | 363 |
| TOLAD ® 9103 Fuel Lubricity Additive | 200 | 454 | — | — |

EXAMPLE 22

WITCAMIDE® 511 alkanolamide (95% by wt.) was blended with TOLAD® 9312 Emulsion Preventive (5% by wt.) by stirring in a suitable container at ambient temperature to produce a uniform product with high flash point (>200° F.) and high pour point (−15° F.).

EXAMPLE 23

Xylylstearyldiethanol amide of Example 1 (95% by wt.) was blended with TOLAD® 9312 Emulsion Preventative (5% by wt.) by stirring at ambient temperature as in Example 22.

EXAMPLE 24

WITCAMIDE® 511H alkanolamide (commercial diethanol amide of refined oleic acid from Witco) (50.0 g.) was mixed with light aromatic naphtha (47.5 g.) and TOLAD® 9312 Emulsion Preventative (2.5 g.) in a flask by stirring at 25° C. The clear product had viscosity of 234 cSt at −20° F. The product was tested for lubricity performance in kerosene at 100 ppm using the Falex Ball-on-Three Disk (BOTD) friction test rig, giving a wear scar (WSD) of 0.304 mm compared to a WSD of 0.455 mm for kerosene containing 100 ppm TOLAD® 9312 Emulsion Preventative.

EXAMPLE 25

Water tolerance of low sulfur diesel fuel treated with the additives of the present invention was evaluated by ASTM D-1094-85, "Standard Test Method for Water Reaction of Aviation Fuels" modified to include a numeric rating of relative fuel clarity.

A sample of the fuel (80 mls.) was shaken, using standardized buffer solution (20 mls.) in 100 ml graduated cylindrical tubes with screw cap closures. The appearance of the interface and the fuel clarity were recorded after 5 minutes of undisturbed settling following shaking. Rating descriptions are given in the following Table 4.

TABLE 4

| Water Tolerance Ratings | |
|---|---|
| Interface Ratings | Fuel Clarity Ratings |
| 1 = Clear and clean<br>1b = Small, clear bubbles covering not more than an estimated 50% of the interface and no shreds, lace or film at the interface<br>2 = Shred, lace, or film at the interface<br>3 = Loose lace or slight scum or both.<br>4 = Tight lace or heavy scum or both. | 1 = Clear/bright, equal to base fuel before mixing with water<br>2 = Very slight haze, fine print readily readable through the tube.<br>3 = Slight haze, tube volume markings and numbers visible through the tube.<br>4 = Hazy, translucent.<br>5 = Opaque |

Results of that testing in three low sulfur diesel fuels are shown in the following Tables 5–7, wherein TOLAD® 9308 Emulsion Preventative and TOLAD® 9312 Emulsion Preventative are as identified in the Detailed Description above.

TABLE 5

| Lubricity Additive | Dose ppm (v/v) | Emulsion Preventative | Dose ppm (v/v) | Interface Rating | Fuel Clarity Rating |
|---|---|---|---|---|---|
| None | — | | | 1 | 1 |
| Example 10 | 50 | | | 3 | 4 |
| Example 10 | 100 | | | 4 | 5 |
| | | | | 3 | 4 |
| Example 10 | 100 | TOLAD ® 9308 Emulsion Preventative | 5 | 2 | 5 |
| Example 10 | 100 | TOLAD ® 9312 Emulsion Preventative | 5 | 2 | 4 |
| TOLAD ® 9103 Fuel Lubricity Additive | 50 | | | 1 | 3 |
| TOLAD ® 9103 Fuel Lubricity Additive | 100 | | | 1b | 3 |
| WITCAMIDE ® 511 Alkanolamide | 100 | | | 4 | 5 |
| WITCAMIDE ® 511H Alkanolamide | 100 | | | 4 | 5 |

TABLE 6

| Lubricity Additive | Dose ppm (v/v) | Emulsion Preventative | Dose ppm (v/v) | Interface Rating | Fuel Clarity Rating |
|---|---|---|---|---|---|
| None | — | | | 1b | 2 |
| | | | | 2 | 2 |
| Example 1 | 100 | | | 4 | 3 |
| Example 10 | 100 | | | 3 | 4 |
| Example 10 | 100 | TOLAD ® 9312 Emulsion Preventative | 5 | 1b | 3 |
| WITCAMIDE ® 511 Alkanolamide | 100 | | | 4 | 4 |
| WITCAMIDE ® 511 Alkanolamide | 100 | TOLAD ® 9308 Emulsion Preventative | 5 | 4 | 4 |
| WITCAMIDE ® 511 Alkanolamide | | TOLAD ® 9312 Emulsion Preventative | 5 | 2 | 4 |
| Example 16 | 100 | | | 3 | 2 |
| Example 19 | 100 | | | 4 | 4 |

TABLE 6-continued

| Lubricity Additive | Dose ppm (v/v) | Emulsion Preventative | Dose ppm (v/v) | Inter-face Rating | Fuel Clarity Rating |
|---|---|---|---|---|---|
| Example 20 | 100 | | | 4 | 4 |
| Example 22 | 100 | | | 4 | 4 |
| Example 23 | 100 | | | 1b | 3 |
| Example 24 | 100 | | | 3 | 2 |

TABLE 7

| Lubricity Additive | Dose ppm (v/v) | Emulsion Preventative | Dose ppm (v/v) | Inter-face Rating | Fuel Clarity Rating |
|---|---|---|---|---|---|
| None | — | | | 3 | 1 |
| Example 24 | 100 | | | 2 | 3 |
| WITCAMIDE ® 511H Alkanolamide | 50 | | | 4 | 4 |
| WITCAMIDE ® 511H Alkanolamide | 100 | | | 4 | 4 |

In view of the above, it will be seen that the several advantages of the invention are achieved and other advantageous results attained.

As various changes could be made in the above methods and compositions without departing from the scope of the invention, it is intended that all matter contained in the above description shall be interpreted as illustrative and not in a limiting sense.

What is claimed is:

1. A method for improving the lubricity of a low sulfur diesel or spark ignition fuel, comprising adding to the fuel a lubricity-increasing amount of a lubricity aid selected from the group consisting of alkanolamides of aryl-substituted fatty acids and combinations of such alkanolamides.

2. A fuel composition of improved lubricity comprising a lubricity-increasing amount of a lubricity aid dissolved in a poor lubricity fuel selected from the group consisting of low sulfur diesel fuel and spark ignition fuels, the lubricity aid being selected from the group consisting of alkanolamides of aryl-substituted fatty of such alkanolamides.

3. A fuel composition as set forth in claim 2 is derived from an alkanolamine that wherein each alkanolamide contains from about 2 to about 6 carbon atoms.

4. A fuel composition as set forth in claim 3 wherein each fatty acid contains from about 12 to about 24 carbon atoms.

5. A fuel composition as set forth in claim 4 wherein each aryl substituent contains from about 6 to about 18 carbon atoms.

6. A fuel composition as set forth in claim 5 wherein the lubricity aid is a dialkanolamide of xylylstearic acid.

7. A fuel composition as set forth in claim 6 wherein the alkanolamide is diethanolamide.

8. A fuel composition as set forth in claim 2, further comprising a dehazer.

9. A fuel composition as set forth in claim 8 wherein the dehazer is selected from the group consisting of glycol oxyalkylate polyol blends, phenol/formaldehyde resin oxyalkylates modified by oxyalkylation with $C_{1-18}$ epoxides and/or diepoxides, alkyil($C_{1-18}$)phenol/-formaldehyde resin oxyalkylates modified by oxyalkylation with $C_{1-18}$ epoxides and/or diepoxides, $C_{1-4}$ epoxide copolymers cross-linked with diepoxides, diacids, diesters, diols, diacrylates, dimethacrylates or diisocyanates, and blends thereof.

10. A fuel composition as set forth in claim 2 wherein the fuel is a spark ignition fuel.

11. A fuel composition as set forth in claim 2 wherein the fuel is low sulfur diesel fuel.

12. A fuel composition as set forth in claim 2 wherein the lubricity-increasing amount is from about 10 to about 500 ppm based on weight of the fuel.

13. A fuel composition as set forth in claim 8 wherein the lubricity-increasing amount is from about 20 to about 100 ppm based on weight of the fuel and the haze-inhibiting amount is from about 1 to about 50 ppm based on the weight of the fuel.

14. A fuel composition as set forth in claim 2 wherein the lubricity-increasing amount is from about 20 to about 100 ppm by weight.

15. A fuel composition as set forth in claim 2 wherein each alkanolamide contains an amide nitrogen and is derived from an alkanolamine that contains from about 2 to about 6 carbon atoms and a hydroxy group or an NH group two carbon atoms away from a nitrogen atom that is the amide nitrogen in the alkanolamide.

16. A fuel composition as set forth in claim 15 wherein each fatty acid contains from about 12 to about 24 carbon atoms.

17. A fuel composition as set forth in claim 16 wherein each aryl substituent contains from about 6 to about 18 carbon atoms.

18. A fuel composition as set forth in claim 17 wherein the lubricity aid is a dialkanolamide of xylylstearic acid.

19. A fuel composition as set forth in claim 18 wherein the alkanolamide is diethanolamide.

20. A fuel lubricity additive comprising about 9 to about 20 parts by weight lubricity aid per part by weight dehazer, the lubricity aid being selected from the group consisting of alkanolamides of aryl-substituted fatty acids and combinations of such alkanolamides.

21. A fuel lubricity additive as set forth in claim 20 wherein the lubricity aid is the dehydration reaction product of at least one amine and at least one fatty acid in an amine to carboxylic group of the fatty acid molar ratio of from about 1.2:1 to about 1:3.

22. A method as set forth in claim 11 wherein the fuel is a low sulfur diesel fuel and after addition of the lubricity aid, the fuel is routed to a fuel pump in a diesel engine.

* * * * *